United States Patent [19]

Granger

[11] Patent Number: 4,956,919

[45] Date of Patent: Sep. 18, 1990

[54] DRYWALL T-SQUARE

[76] Inventor: James P. Granger, 7621B Broughton St., Sarasota, Fla. 34243

[21] Appl. No.: 406,033

[22] Filed: Sep. 11, 1989

[51] Int. Cl.[5] ..... B43L 13/00

[52] U.S. Cl. ..... 33/32.2; 33/42

[58] Field of Search ..... 33/42, 41.1, 41.5, 32.1, 33/32.2, 32.3, 403, 430, 436, 437, 443; 30/290, 293, 289, 294

[56] References Cited

U.S. PATENT DOCUMENTS

| | | | |
|---|---|---|---|
| 581,437 | 4/1897 | Silliker | 33/474 |
| 840,928 | 1/1907 | Gamston et al. | 33/32.3 X |
| 991,693 | 5/1911 | Brown | 33/42 |
| 1,624,280 | 4/1927 | Rasmusen | 33/437 X |
| 3,378,927 | 4/1968 | Lowery | 33/32.3 X |

*Primary Examiner*—Harry N. Haroian

*Attorney, Agent, or Firm*—Leon Gilden

[57] ABSTRACT

A first positioning rule is oriented for mounting overlying edge portions of associated plaster drywall sheets. A second rule slidably mounted to the first rule includes a series of slots for receiving a cutting tool therewithin to effect scoring and cutting of the associated drywall sheet. The slots include overlying plate members of metallic construction received within recesses of the drywall rule to avoid damage to the rule in use of a cutting tool.

8 Claims, 4 Drawing Sheets

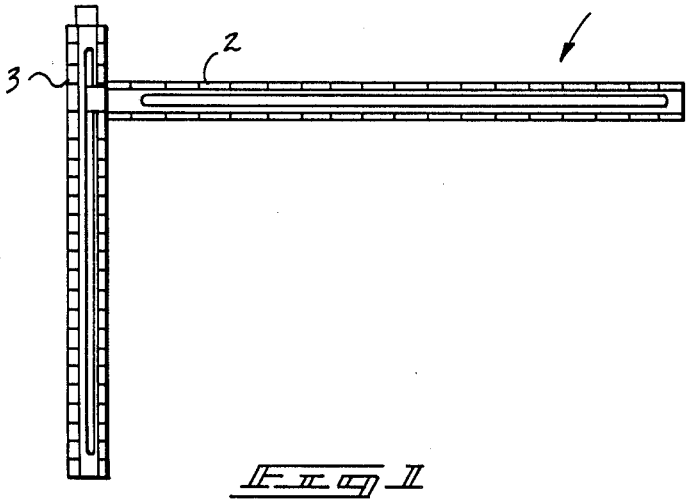
Fig 1
PRIOR ART
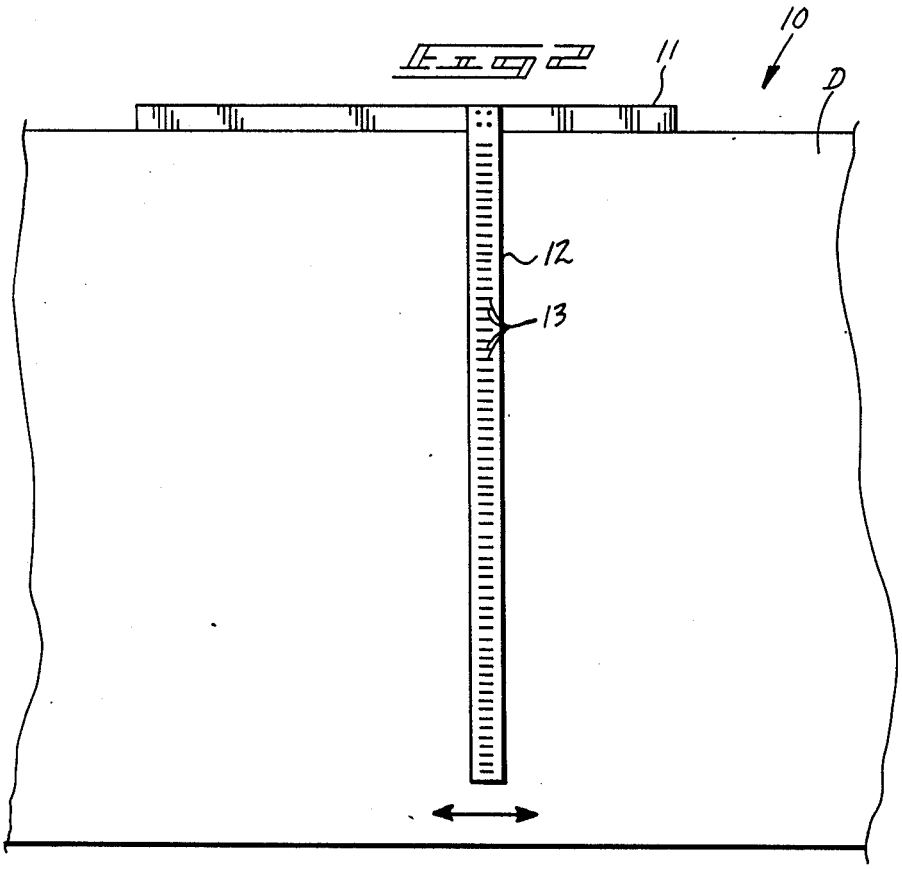

DRYWALL T-SQUARE

BACKGROUND OF THE INVENTION

1. Field of the Invention

The field of invention relates to drywall tools, and more particularly pertains to a new and improved drywall T-square wherein the same utilizes a series elongate slots equally spaced and formed within a slidable rule portion to effect scoring and cutting of associated drywall panels.

2. Description of the Prior Art

T-squares of various types have been utilized in the prior art to gauge and position measurements for subsequent procedures. The drywall tools of the prior art, however, have failed to provide a rapid and efficient manner of effecting scoring and cutting of an associated drywall panel with the attendant simplicity and effectiveness of the organization of the instant invention. Examples of the prior art include U.S. Pat. No. 4,599,805 to Padilla setting forth the use of a first rule slidably mounted at a second rule for effecting measuring operations.

U.S. Pat. No. 965,945 to Roman provides a drafting implement provided with openings for receiving a marking instrument such as a pencil therethrough.

U.S. Pat. No. 557,804 to Hammers sets forth a T-square utilizing a plurality of scales in the body and head of the T-square member.

U.S. Pat. No. 2,226,302 to Aswad provides a gauge for use with stone work, wherein the gauge includes a T-square member with a further member slidably mounted overlying the body of the T-square member to position the stone work portions relative to one another.

U.S. Pat. No. 4,279,081 to Wing provides a T-square utilizing retractable pins within the body of the T-square for attachment of the T-square to drywall products.

As such, it may be appreciated that there is a continuing need for a new and improved drywall T-square wherein the same addresses both the problems of ease of use and effectiveness in construction and in this respect, the present invention substantially fulfills this need.

SUMMARY OF THE INVENTION

In view of the foregoing disadvantages inherent in the known types of T-squares now present in the prior art, the present invention provides a drywall T-square wherein the same provides slots for receiving a cutting tool and marking implements therethrough. As such, the general purpose of the present invention, which will be described subsequently in greater detail, is to provide a new and improved drywall T-square which has all the advantages of the prior art T-squares and some of the disadvantages.

To attain this, the present invention includes a first positioning rule slidably mounting a second rule member relative thereto, wherein the second rule member includes a series of slots positioned at predetermined gradations along the body of the second rule, and wherein the slots extend through the body of the rule to accept a cutting tool therethrough to effect scoring and cutting of an underlying drywall panel. The slot portions include overlying plates and alignment circles with optional dust escape slots positioned within the plate for enhancing the effectiveness of the device in operation.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drywall T-square which has all the advantages of the prior art T-squares and none of the disadvantages.

It is another object of the present invention to provide a new and improved drywall T-square which may be easily and efficiently manufactured and marketed.

It is a further object of the present invention to provide a new and improved drywall T-square which is of a durable and reliable construction.

An even further object of the present invention is to provide a new and improved drywall T-square which is susceptible of a low cost of manufacture with regard to both materials and labor, and which accordingly is then susceptible of low prices of sale to the consuming public, thereby making such drywall T-squares economically available to the buying public.

Still yet another object of the present invention is to provide a new and improved drywall T-square which provides in the apparatuses and methods of the prior art some of the advantages thereof, while simultaneously overcoming some of the disadvantages normally associated therewith.

Still another object of the present invention is to provide a new and improved drywall T-square wherein the same enables positioning of a cutting tool at predetermined intervals along the slidable portion of the T-square to effect scoring of an underlying drywall panel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top orthographic view of a typical prior art T-square.

FIG. 2 is a top orthographic view of the instant invention overlying a plaster drywall panel.

DESCRIPTION OF THE PREFERRED EMBODIMENT

Figure 3:
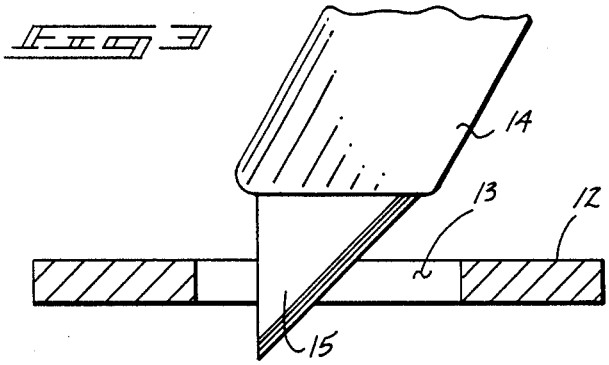
FIG. 3 is an orthographic cross-sectional view of a cutting tool in association with a slot of the instant invention.
Figure 4:
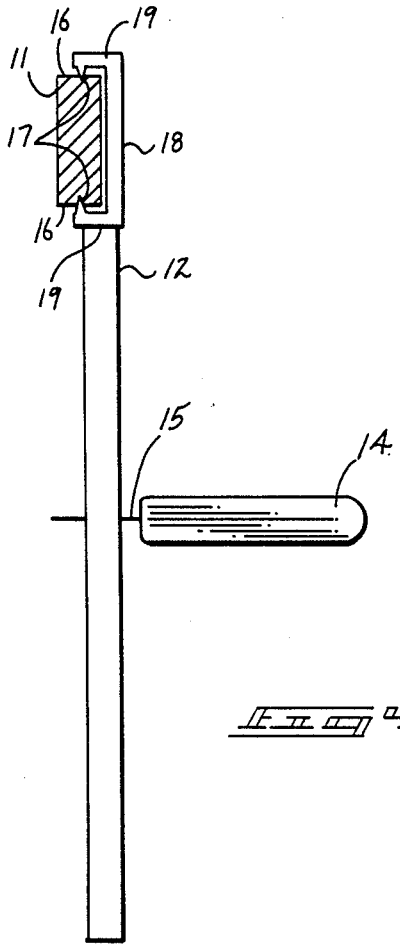
FIG. 4 is an orthographic cross-sectional side view of the instant invention in cooperation with a cutting tool.

With reference now to the drawings, and in particular to FIGS. 1 to 8 thereof, a new and improved drywall T-square embodying the principles and concepts of the present invention and generally designated by the reference numeral 10 will be described.

More specifically, the drywall T-square 10 essentially comprises a first positioning rule member 11 slidably receiving a second rule member 12 orthogonally thereto. The second rule member 12 includes a series of graduated slots 13. The slots 13 are approximately 0.025 inches in width, 0.75 inches long, and are spaced at $\frac{1}{8}$ inch intervals along the body of the second rule member 12. The second rule member 12 is slidably mounted relative to the first rule member 11 to enable reciprocation coextensively with the length of the first rule member 11.

Reference to FIG. 3 illustrates the second rule member 12 and a typical slot 13 receiving a manually operable cutting tool 14. The cutting tool 14 includes a pointed blade member 15 projecting from an end therethrough, wherein the blade member is of a width of complementary configuration to the width of the slot 13. The first rule member 11 includes a series of opposed elongate parallel sides 16 with elongate "V" shaped tracks 17 formed orthogonally through the sides 16, wherein the tracks 17 are aligned relative to one another to receive the head portion 18 of the second rule member 12. The head portion 18 includes a pair of downwardly directed parallel side flanges 19 oriented generally orthogonally to the top surface of the head portion 18 and coextensive with the head portion 18. The flanges 19 each include an elongate "V" shaped guide projection 20 coextensive with the flanges 19 and receivable within the tracks 17 of the side wall 16 to enable reciprocation of the head portion 18 and the body of the second rule member 12 relative to the first rule member 11.

Figure 5:
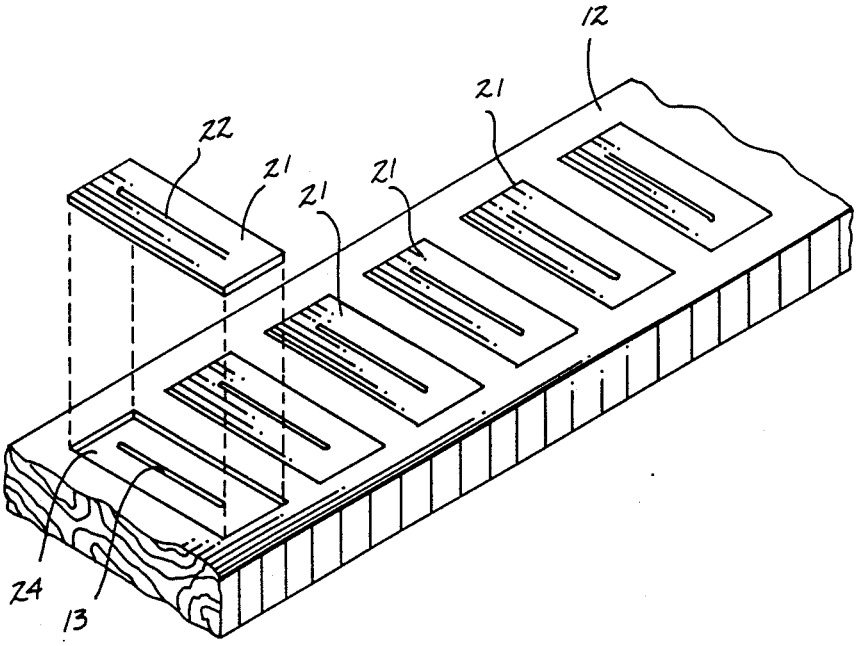
FIG. 5 is an isometric illustration of the rule body of the instant invention and the replaceable plates mounted therein.
Figure 6:
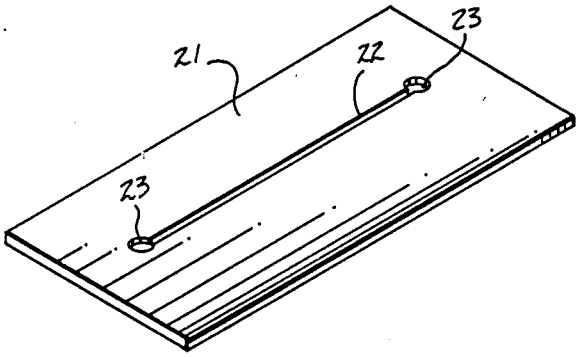
FIG. 6 is an isometric illustration of a guide plate as utilized by the instant invention.
Figure 7:
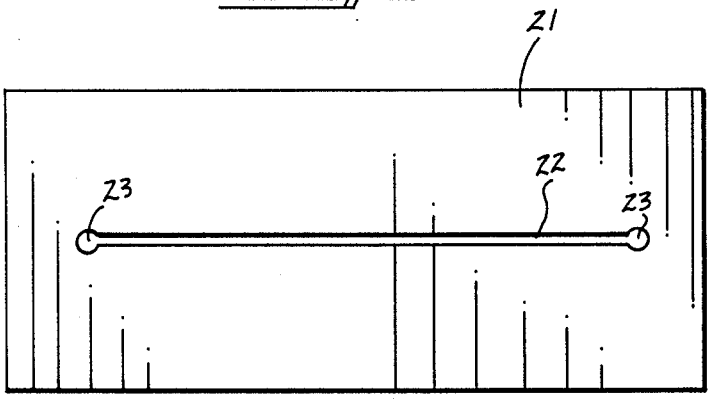
FIG. 7 is an orthographic top view of the guide plate as utilized by the instant invention.

Reference to FIGS. 5–7 illustrates the body 12 of the second rule member 11 formed of a generally non-metallic material, such as wood and the like, to minimize marring of an underlying gypsum of plaster drywall sheet "D" as it is slid relative thereto. The body 12 includes a series of metal guide plates 21 defined as generally, rectangular parallelepipeds with a slot 22 coextensive with and overlying a respective slot 13 of the second rule member 12. The guide plate slot 22 is provided with a circular relief aperture 23 at each terminal end thereof to overlie the underlying slot 13 to enable reception of a marking device, such as a pencil therewithin, and guide the pencil in a desired straight-line orientation relative to the underlying drywall panel, and further effects passage of dust and debris therethrough during the cutting operation involving the cutting tool 14 traversing the underlying drywall panel "D". Each metal guide slot 21 is received within a recess 24 of a complementary configuration to the metal guide plate 21, also of a rectangular parallelepiped configuration.

Figure 8:
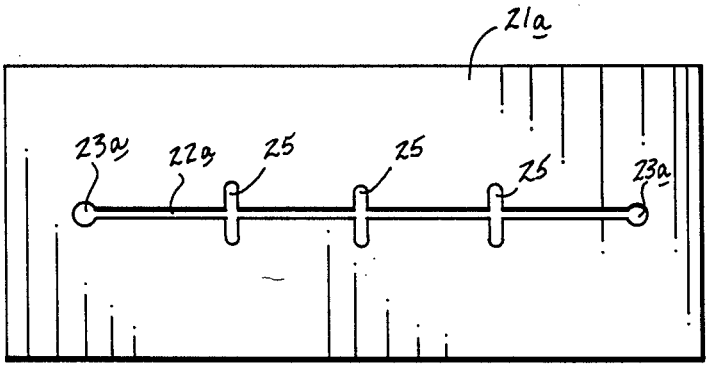
FIG. 8 is an orthographic top view of a modified guide plate as utilized by the instant invention.

Reference to FIG. 8 illustrates a modified metal guide slot **21*a* where, in addition to the slot 22*a* and circular relief apertures 23*a*, includes a series of dust relief slots 25 directed orthogonally to and in communication with the central slot 22 to enhance a directing of dust and debris through the slot 22*a*** during a cutting operation, as described above.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A T-square for marking and scoring drywall comprising, a first rule positioning member and a second rule member slidably mounted orthogonally relative to the first rule member, and track means formed in the first rule member for slidably receiving said second rule member, and a cutting tool, and a plurality of slot means formed in the second rule member for aligning and guiding the tool and the second rule member relative to the first rule member, and wherein the first rule member includes a plurality of side walls, and the track means includes a single elongate groove formed continuously within each side wall, and the grooves aligned and parallel relative to one another within the side walls of the first rule member, and the second rule member including a head portion slidably engaging and overlying the first rule member, the head portion including a plurality of downwardly directed flanges parallel relative to one another and orthogonally oriented relative to a top surface of the head member, and a "V" shaped guide projection formed coextensively on confronting surfaces of the flanges, the projections slidably received within the grooves, and wherein the slot means includes a series of slots parallel to one another oriented orthogonally relative to side edges of the second rule member, and the tool including a pointed blade directed exteriorly therefrom selectively receivable within each slot.

2. A T-square as set forth in claim 1 wherein each slot is defined and oriented within a recess of a rectangular parallelepiped configuration.

3. A T-square as set forth in claim 2 further including a guide plate of a rectangular parallelepiped configuration and of a complementary configuration to that defined by each recess, and the guide plate including a further slot, the further slot coextensive with and overlying the slot when the guide plate is positioned within a respective recess.

4. A T-square as set forth in claim 3 wherein the second rule member is formed of a fibrous material and the guide plate is formed of a metallic material.

5. A T-square as set forth in claim 4 wherein each further slot includes a circular recess directed through the guide at each terminal of the further slot.

6. A T-square as set forth in claim 5 wherein the further slot further includes a plurality of relief slots positioned between the circular recesses directed orthogonally and in communication with the further slot.

7. A T-square as set forth in claim 6 wherein the elongate "V" shaped projections are of a complementary configuration to the respective grooves defined by a "V" shaped cross-sectional configuration.

8. A T-square as set forth in claim 7 wherein the slots are spaced at $\frac{1}{8}$ inch intervals, and the slots are each 0.75 inches long, and each slot member is 0.025 inches wide.

* * * * *